US007812774B2

(12) United States Patent
Friman et al.

(10) Patent No.: US 7,812,774 B2
(45) Date of Patent: Oct. 12, 2010

(54) ACTIVE TUNED LOOP-COUPLED ANTENNA

(75) Inventors: Alf Friman, Växjö (SE); Sverker Petersson, Nybro (SE); Laurent Desclos, San Diego, CA (US); Jeffrey Shamblin, San Marcos, CA (US)

(73) Assignee: Ethertronics, Inc., San Diego, CA (US)

( * ) Notice: Subject to any disclaimer, the term of this patent is extended or adjusted under 35 U.S.C. 154(b) by 232 days.

(21) Appl. No.: 12/117,669

(22) Filed: May 8, 2008

(65) Prior Publication Data

US 2009/0278756 A1 Nov. 12, 2009

(51) Int. Cl.
*H01Q 7/00* (2006.01)

(52) U.S. Cl. ..... 343/748; 343/745

(58) Field of Classification Search ..... 343/745, 343/748, 850, 860, 861

See application file for complete search history.

(56) References Cited

U.S. PATENT DOCUMENTS

| | | | | |
|---|---|---|---|---|
| 5,874,926 | A * | 2/1999 | Tsuru et al. | 343/860 |
| 7,109,945 | B2 * | 9/2006 | Mori | 343/861 |
| 2007/0290934 | A1 * | 12/2007 | Nakamura et al. | 343/702 |
| 2008/0252549 | A1 * | 10/2008 | Ohtaki et al. | 343/861 |

* cited by examiner

*Primary Examiner*—Hoang V Nguyen
(74) *Attorney, Agent, or Firm*—Coastal Patent, LLC; Joshua S. Schoonover

(57) ABSTRACT

An active tuned loop-coupled antenna capable of optimizing performance over incremental bandwidths and capable of tuning over a large total bandwidth to be used in wireless communications. The active loop is capable of serving as the radiating element or a radiating element can be coupled to this active loop. Multiple active tuned loops can be coupled together to extend the total bandwidth of the antenna. Active components can be incorporated into the antenna structure to provide yet additional extension of the bandwidth along with increased optimization of antenna performance over the frequency range of the antenna.

27 Claims, 10 Drawing Sheets

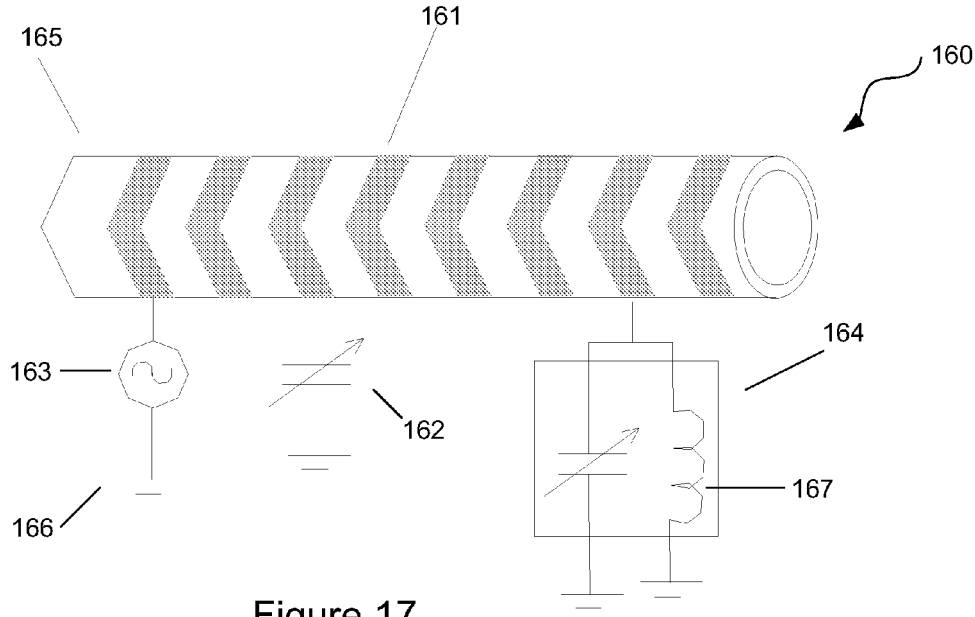
Figure 17
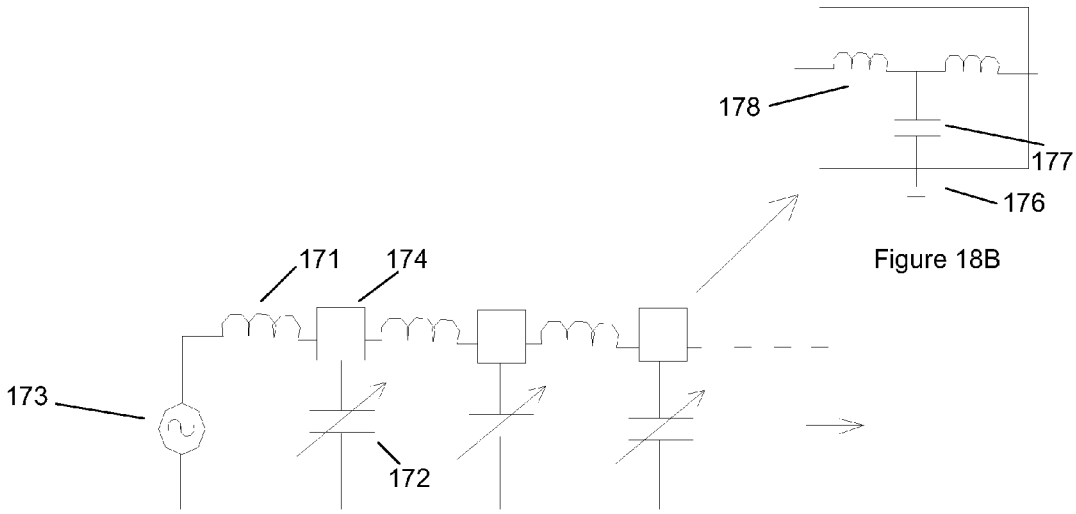
Figure 18B
Figure 18A

ACTIVE TUNED LOOP-COUPLED ANTENNA

FIELD OF INVENTION

The present invention relates generally to the field of wireless communication. In particular, the present invention relates to antenna for use with such wireless communication.

BACKGROUND OF THE INVENTION

As new generations of handsets and other wireless communication devices become smaller and embedded with more applications, new antenna designs are needed to provide solutions that address the limitations of these devices. Increasing frequency bandwidth of internal antennas for media applications in cell phones is one example. More specifically, TV reception is one of the next major trends in mobile phone technology. However, standard technologies require that antennas be made larger when operated at low frequencies. Mobile handsets are very small compared to terrestrial TV antennas normally required for good signal reception. Further, as phones have become more compact, near field interactions have become an increasing problem.

Antenna performance is a key parameter for good reception quality. With classical antenna structures, a certain physical volume is required to produce a resonant antenna structure at a particular radio frequency and with a particular bandwidth. In multi-band applications, more than one such resonant antenna structure may be required. Further, the internal TV antenna should not interfere with the main antenna or other ancillary antennas in the handset. Embodiments of the present invention address deficiencies of conventional antenna designs.

SUMMARY OF THE INVENTION

One aspect of the present invention relates to an antenna element that comprises one or more active tuning components for providing capacitive reactance and one or more conductive elements in loop formations being coupled to the one or more conductive elements, wherein the combination of the one or more active tuning components and one or more conductive elements form one or more active tuned loops. One embodiment of the invention provides that the antenna is capacitively coupled with the active tuned loop. Another embodiment provides that the antenna is conductively coupled with the active tuned loop. Yet another embodiment of the present invention provides that the active tuning component located within the active tuned loop may include a varactor diode, tunable capacitor or switched capacitor network or a combination of these components.

Another embodiment of the present invention provides that the antenna may include one or more radiating elements that are in connection with the one or more active tuned loops. A further embodiment provides that the one or more radiating elements may be any one of monopoles, inverted F antennas (IFA), planar inverted F antennas (PIFA), IMD elements, or dipoles. Yet a further embodiment provides that one or more active components are coupled to one or more radiating elements. Another embodiment provides that the one or more radiating elements are magnetically coupled to the one or more active tuned loops.

Another embodiment of the present invention provides that the antenna is a ferrite loaded coil antenna. One embodiment provides that the conductive element within the antenna may be any one of a wire, rectangular conductor or printed conductive pattern. Another embodiment provides that the antenna is positioned within a hinge region of a wireless device. Yet another embodiment provides that the coil is replaced with a radiating element. Another embodiment provides that the ferrite is attached to a top surface of a shield can. A further embodiment provides that an active tuned circuit is coupled to the radiating element.

Another aspect of the present invention provides a method for configuring an antenna structure that comprises providing one or more active tuning component which provides capacitive reactance and coupling one or more conductive elements in loop formations to the one or more active tuning component and having the combination of the one or more active tuning components and one or more conductive elements form one or more active tuned loops.

BRIEF DESCRIPTION OF THE DRAWINGS

FIG. 17 illustrates an exemplary hinge assembly for a communication device in accordance with an embodiment of the present invention.

FIGS. 18A and 18B are schematic illustrations of an antenna in accordance with an embodiment of the present invention.

DETAILED DESCRIPTION OF CERTAIN EMBODIMENTS

In the following description, for purposes of explanation and not limitation, details and descriptions are set forth in order to provide a thorough understanding of the present invention. However, it will be apparent to those skilled in the art that the present invention may be practiced in other embodiments that depart from these details and descriptions.

Embodiments of the present invention provide an active tuned loop-coupled antenna capable of optimizing an antenna over incremental bandwidths and capable of tuning over a large total bandwidth. The active loop element is capable of serving as the radiating element or an additional radiating element may also be coupled to this active loop. In various embodiments, multiple active tuned loops can be coupled together in order to extend the total bandwidth of the antenna. Such active components may be incorporated into the antenna structure to provide further extensions of the bandwidth along with increased optimization of antenna performance over the frequency range of the antenna. In certain embodiments, the radiating element may be co-located with a ferrite material and active components coupled to the element to tune across a wide frequency range.

Figure 1:
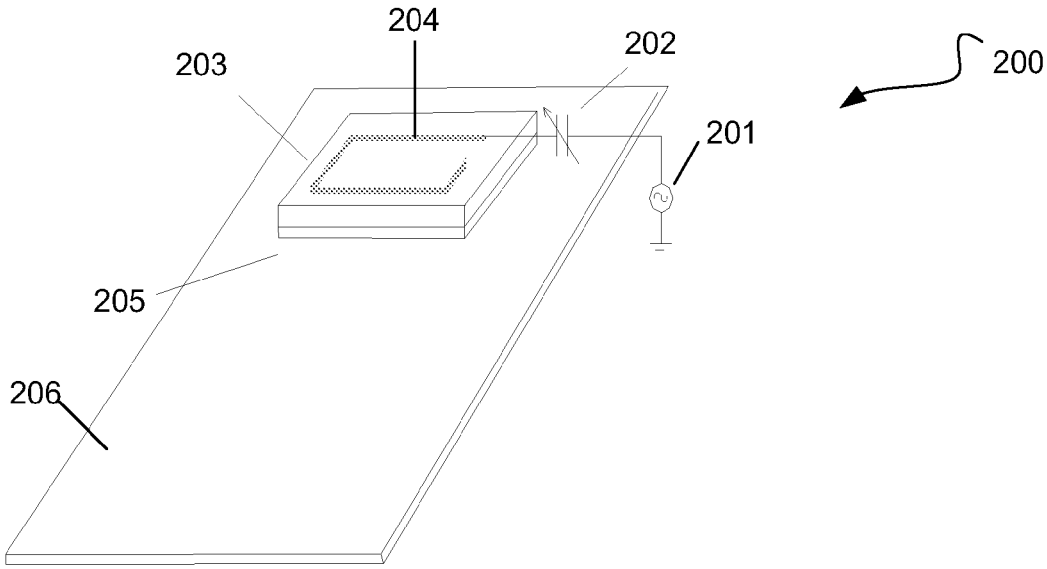
FIG. 1 illustrates an antenna in accordance with an embodiment of the present invention.

FIG. 1 illustrates an antenna 200 in accordance with an embodiment of the present invention having one configuration of ferrite support 203 attached to the top of a shield can 205. The shield can 205 may serve to provide electromagnetic shielding. A conductive element 204 is provided in connection with an active tuned circuit, which includes an active component 202 and a grounded signal generator 201. The conductive element 204 is attached to the top of the ferrite support 203 configuration. The ferrite support 203 provides for less resistive loss due to its high permittivity. The antenna 200 may be coupled to a substrate 206 for grounding, such as the circuit board, or a housing of a wireless device. The configuration illustrated in FIG. 1 may be utilized in, for example, a wireless device housing 206.

Figure 2:
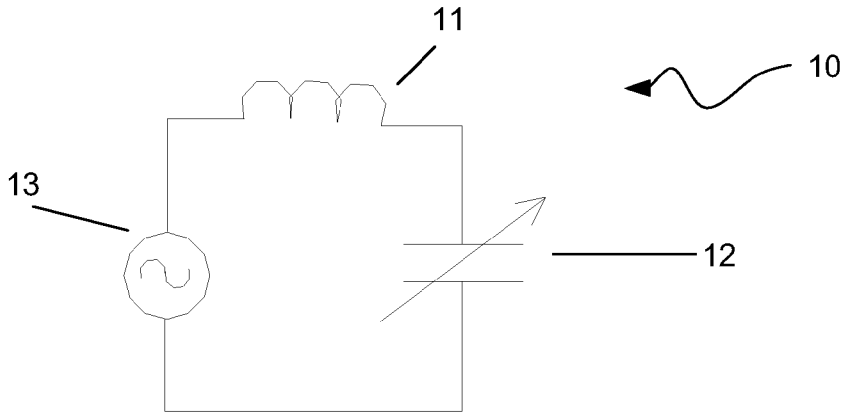
FIG. 2 is a schematic illustration of an antenna in accordance with an embodiment of the present invention.

Referring now to FIG. 2, an exemplary antenna 10 in accordance with an embodiment of the invention is schematically illustrated. In this embodiment, the antenna 10 forms an active tuned loop circuit which acts as a radiator and is formed through the combination of a conductive element in a loop 11 and an active component 12 in series. The conductive element, or loop 11, may be any one of a wire, rectangular conductor or printed conductive pattern. A signal generator 13 may provide an excitation to the circuit and the active component 12 used to adjust the reactance of the loop 11. The active component 12 may be any type of a switch, varactor diode, tunable capacitor or other such active component. The usage of the active component 12 facilitates optimization of radiation efficiency and causes the loop 11 to behave as a radiator.

Figure 3:
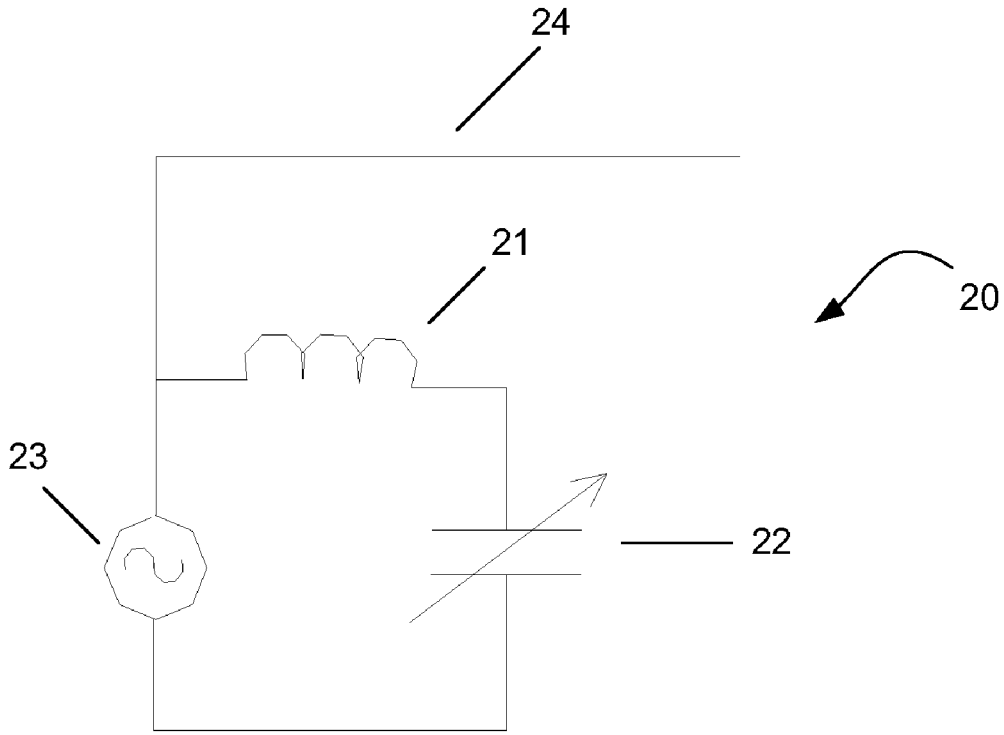
FIG. 3 is a schematic illustration of an antenna in accordance with an embodiment of the present invention.

Referring now to FIG. 3, an antenna formed as an active tuned loop circuit 20 behaving as a radiator may be further enhanced through the addition of a radiating element 24. The addition of the radiating element 24, which may be any one or more of monopoles, inverted F antennas (IFA), planar inverted F antennas (PIFA), IMD elements, or dipoles, or the like, allows for impedance matching with an active component 22 and a conductive loop 21 over a large frequency range. This is achieved by producing incremental instantaneous bandwidths combined to cover a total wide bandwidth response. This may be particularly important in applications such as television broadcasting on wireless devices. In order to achieve good efficiency from an internal antenna required to cover the large TV frequency band, one solution is to actively tune the antenna 20 over narrow instantaneous bandwidths. This can be additionally achieved through the signal generator which allows for enhanced control of the circuit through tunable and variable frequencies.

Figure 4:
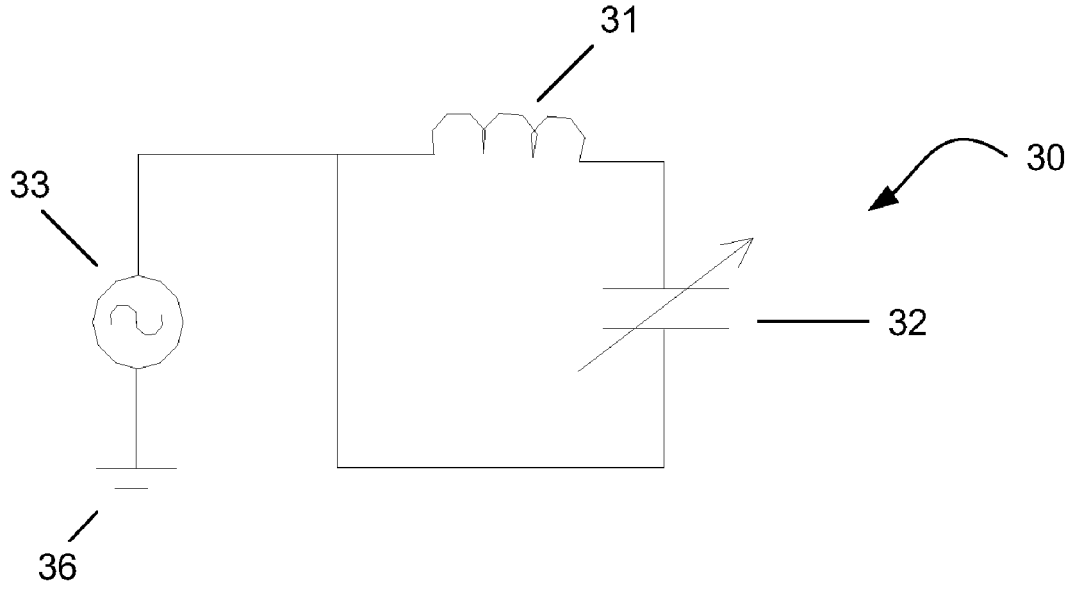
FIG. 4 is a schematic illustration of an antenna in accordance with another embodiment of the present invention.

Referring now to FIG. 4, an antenna 30 in accordance with another embodiment of the present invention is illustrated. The active component 32, which may be any of a switch, varactor diode, tunable capacitor or other active component, serves to adjust the reactance of a conductive loop 31. This will allow for tunable frequencies, which in turn optimize the radiation efficiency.

Figure 5:
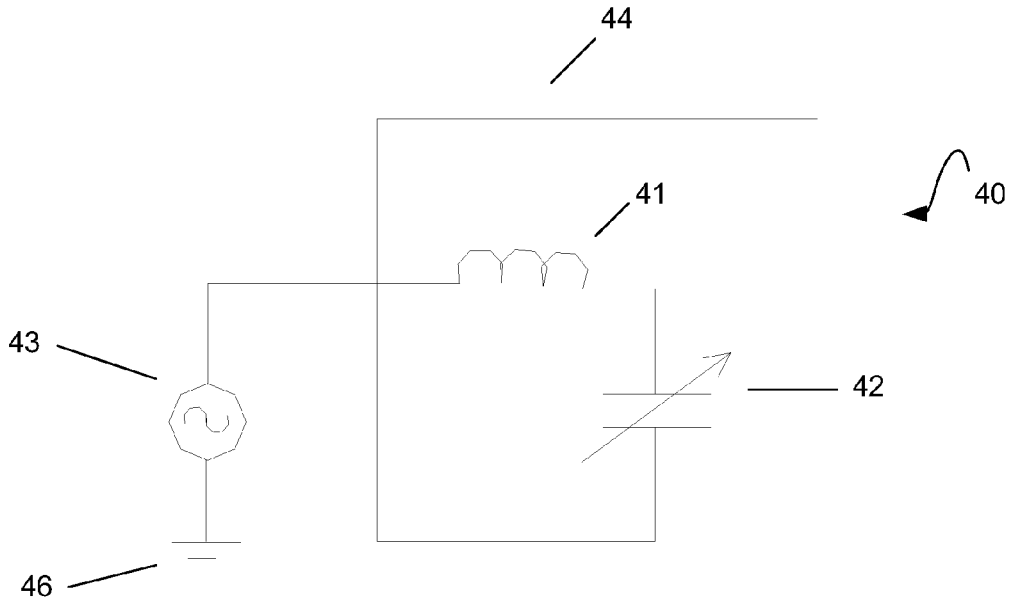
FIG. 5 is a schematic illustration of an antenna in accordance with an embodiment of the present invention.

Referring now to FIG. 5, an antenna in accordance with an embodiment of the present invention is schematically illustrated. The antenna loop circuit forms an ungrounded state device 40 with a radiating element 44 coupled to the device 40.

Figure 6:
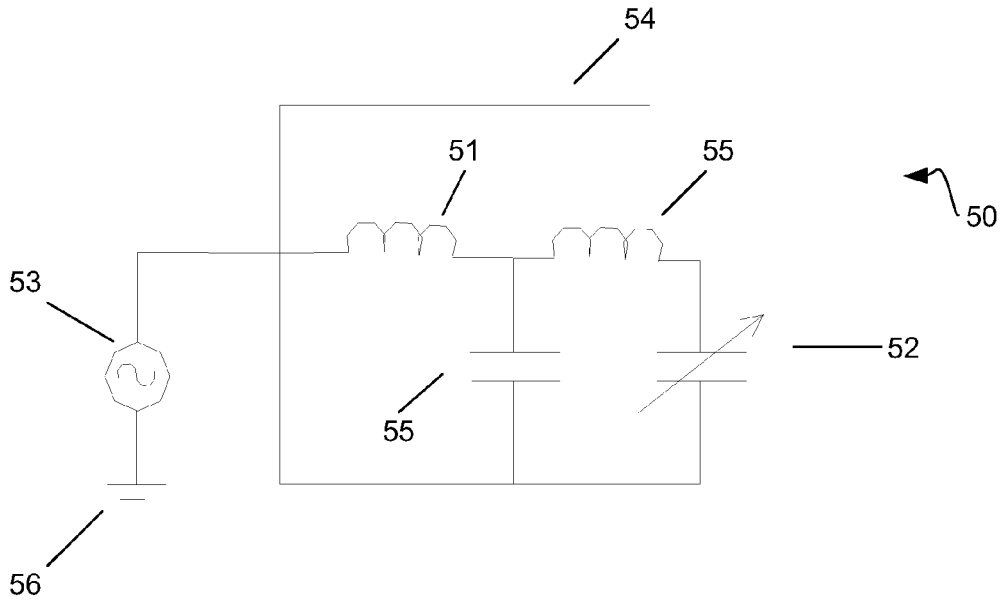
FIG. 6 is a schematic illustration of an antenna in accordance with an embodiment of the present invention.

FIG. 6 schematically illustrates an antenna in accordance with another embodiment of the present invention. The embodiment illustrated in FIG. 6 provides a configuration of an active tuned loop circuit 50 having additional reactive components 55 incorporated into the active tuned loop circuit in order to increase the frequency bandwidth of the antenna. The reactive components 55 may be capacitors, inductors, resistors or similar type components. A radiating element 54 provides transmission and reception of electromagnetic energy and may be any one of monopoles, inverted F antennas (IFA), planar inverted F antennas (PIFA), IMD elements, or dipoles, for example. The addition of the capacitor and inductor as reactive components creates increased reactance within the loop. In addition, the ungrounded state causes the circuit 50 to behave similarly to the antenna loop circuit of FIG. 4.

Compared to an antenna structure that covers the whole frequency range without tuning, the tunable antenna greatly improves the antenna radiation efficiency for the same physical volume constraint. Additional active tuned loops can be combined to extend the frequency range to cover multiple octaves, thereby satisfying a wide range of antenna applications. With the ability to cover multiple octaves, FM, DMB, and DVB-H applications can be addressed with internal antennas which will provide the required efficiency.

Figure 7:
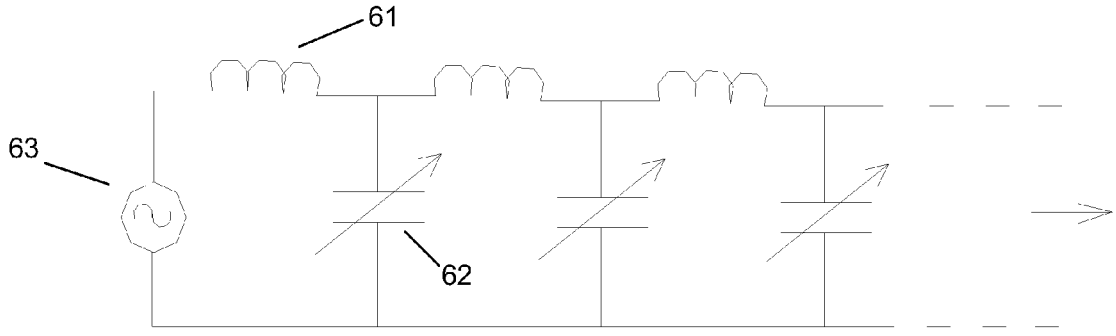
FIG. 7 is a schematic illustration of an antenna in accordance with an embodiment of the present invention.

Accordingly, FIG. 7 schematically illustrates an antenna in accordance with an embodiment of the present invention. The embodiment illustrated in FIG. 7 includes multiple paralleled active tuned looped circuits coupled in order to form a composite antenna structure 60 that covers a wider range of frequency.

Figure 8:
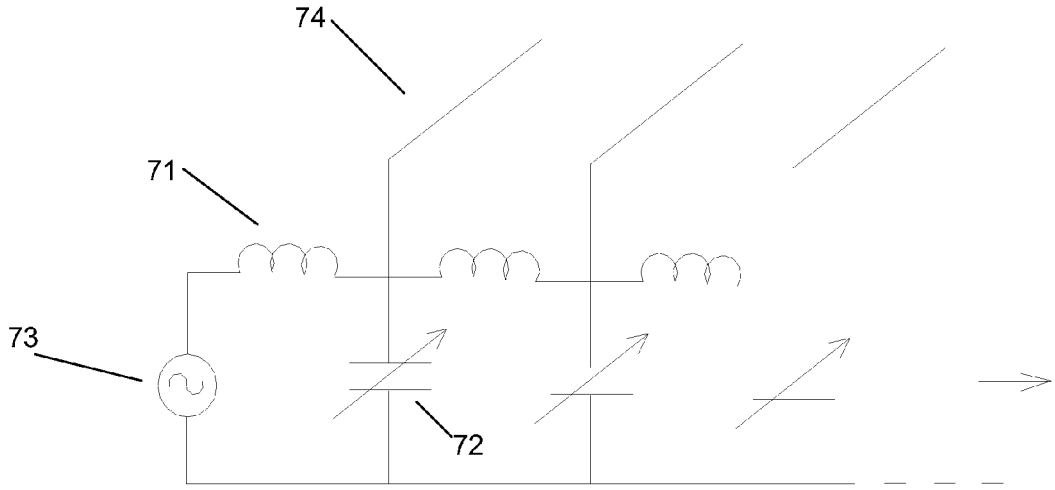
FIG. 8 is a schematic illustration of an antenna in accordance with an embodiment of the present invention.

In other embodiments, as illustrated in FIG. 8, radiating elements 74 may be joined between each active tuned loop circuit. In the embodiment illustrated in FIG. 8, multiple actively tuned circuits are placed in a series with radiating elements 74 splitting each conductive loop 71 and active component 72 in order to impedance match each circuit. The matching may provide a more optimal reception. The radiating elements 74 may be placed between each tuned loop circuit or selectively placed in order to achieve the specifically desired resonant frequencies. The more active tuned loops that are added within the series provides for more precise tuning at a broader range of frequencies through optimized radiation efficiency, which may be done until the desired frequencies are achieved.

Figure 9:
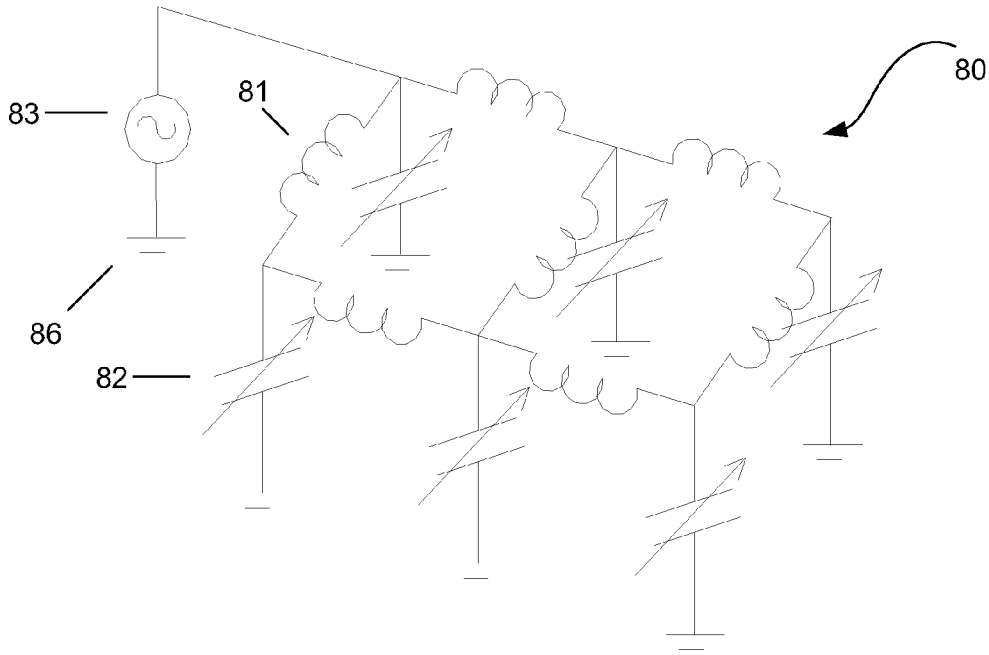
FIG. 9 is a schematic illustration of an antenna in accordance with another embodiment of the present invention.

FIG. 9 schematically illustrates an antenna structure in accordance with an embodiment of the present invention that forms a wide band antenna 80. In this configuration, each active tuned loop circuit behaves as a radiator, like the embodiment illustrated in FIG. 2. This provides increased matching between each circuit for optimized and specific radiating efficiency.

Figure 10:
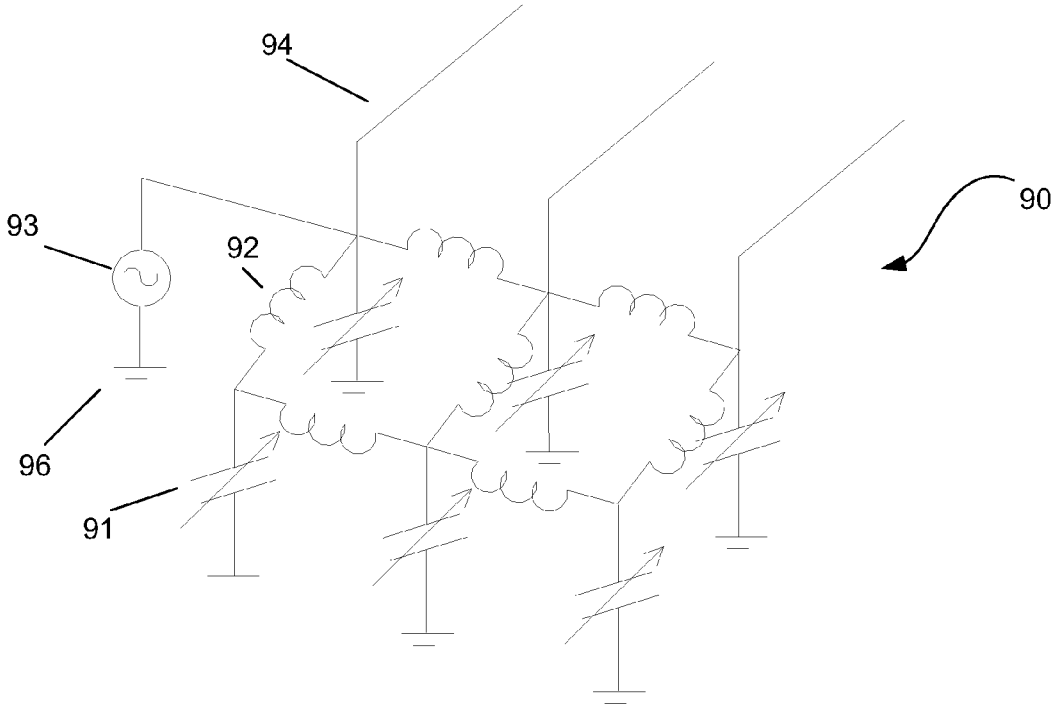
FIG. 10 is a schematic illustration of an antenna in accordance with an embodiment of the present invention.

Referring now to FIG. 10, an embodiment of an antenna structure 90 is provided with additional radiating elements 94. The radiating elements 94 may be any one or more of monopoles, inverted F antennas (IFA), planar inverted F antennas (PIFA), IMD elements, or dipoles, for example. The embodiment illustrated in FIG. 10 only includes radiating elements 94 on the rear three circuits. However, more or less radiating elements 74 may be provided to match specifically tuned frequency bands for the desired application.

Figure 11A:
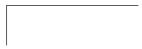
FIGS. 11A-G illustrates various antenna configurations in accordance with embodiments of the present invention.
Figure 11B:
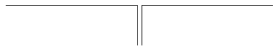
Figure 11C:
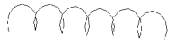
Figure 11D:
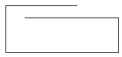
Figure 11E:
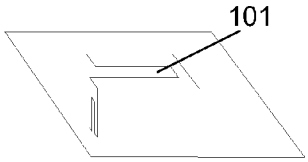
Figure 11F:
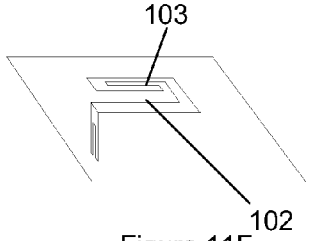
Figure 11G:
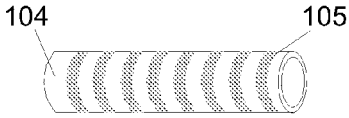

FIGS. 11A-F illustrate various antenna configurations in accordance with embodiments of the present invention. In the illustrated embodiments, radiating elements may be coupled to various embodiments of active tuned loop circuits. FIGS. 11A-C illustrate a wire element (FIG. 11A), a dipole element (FIG. 11B) and a coil element (FIG. 11C). More complex embodiments, such as that illustrated in FIG. 11D, provide a wire isolated magnetic dipole (IMD) element. FIGS. 11E and 11F provide variations of the IMD element that provide singular resonance 101 in the slot region of the device and a dual resonance 102, 103 in the two slot regions of the device, respectively. FIG. 11G provides a further configuration of a ferrite loaded coil where the conductive element 105 is looped around a ferrite rod 104. The conductive element 105 may be any one of a wire, rectangular conductor or printed conductive pattern, for example.

The ferrite core is particularly utilized because of its high permeability, which helps to concentrate the magnetic fields. Further, the ferrite loaded coil antennas are applicable to low frequency receive applications. All of these aforementioned radiating elements are not limited to the types shown and may be varied according to desired frequency characteristics within each respective device in which the circuit may be utilized.

Figure 12:
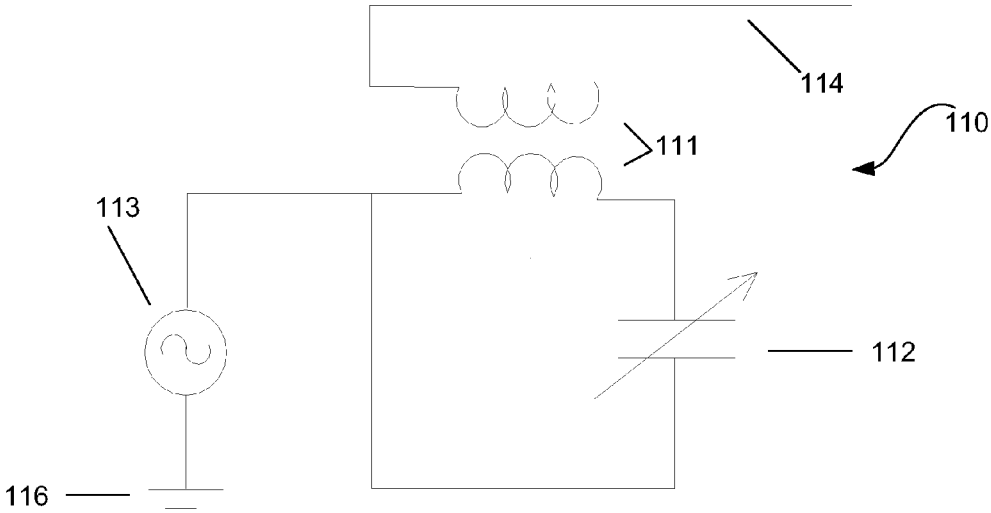
FIG. 12 is a schematic illustration of an antenna in accordance with another embodiment of the present invention.

FIG. 12 is a schematic illustration of an antenna in accordance with another embodiment of the present invention. In the embodiment of FIG. 12, a radiating element 114 is added to an ungrounded active tuned loop. An additional conductive loop 111 can be added to the radiating element 114, which may be magnetically coupled to the active tuned loop circuit.

Figure 13:
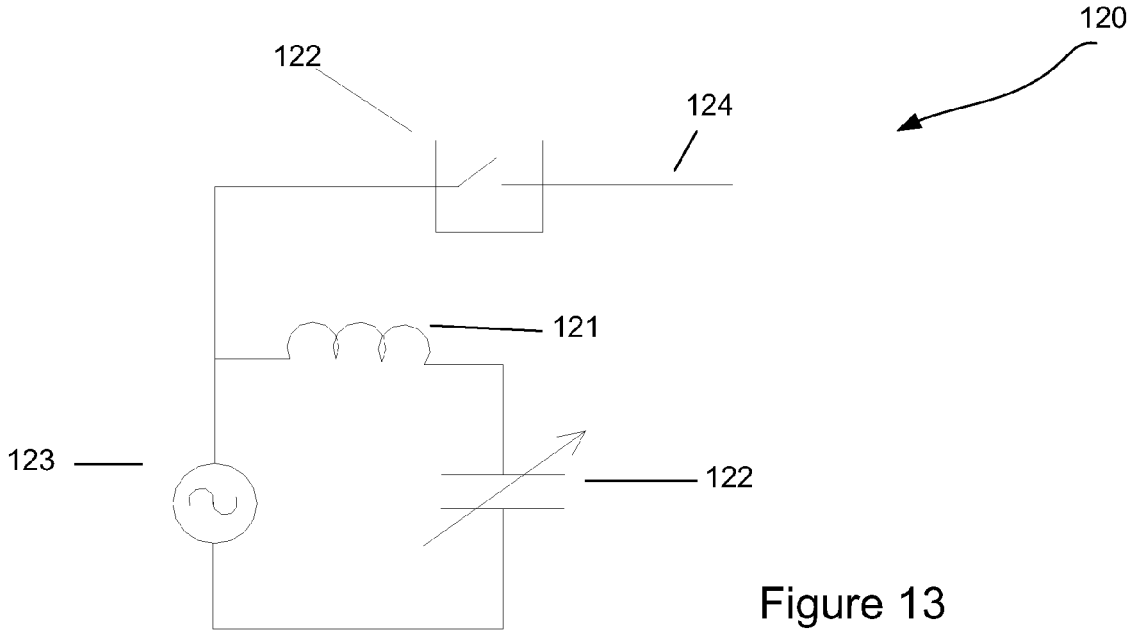
FIG. 13 is a schematic illustration of an antenna in accordance with an embodiment of the present invention.

In another embodiment of the present invention, as illustrated in FIG. 13, an active tuned loop circuit 120 includes a radiating element 124. The radiating element 124 includes an active component 122 to increase the frequency range of the antenna. The active component 122 may be a switch, varactor diode, tunable capacitor or other active component, for example. In addition, the radiating element 124 may be any one of monopoles, inverted F antennas (IFA), planar inverted F antennas (PIFA), IMD elements, or dipoles, for example. However, the present invention is not intended to be limited to these types of antennas. The addition of this component to the circuit design may provide improved optimization of the radiation efficiency.

Figure 14:
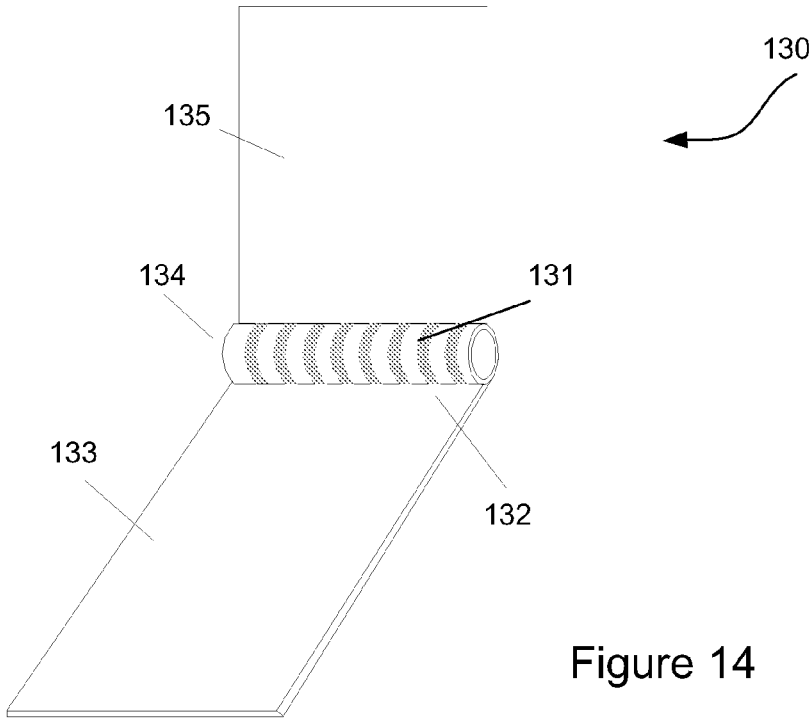
FIG. 14 illustrates an exemplary communication device with an antenna.

FIG. 14 illustrates an embodiment of an exemplary communication device 130. The communication device 130 includes a ferrite rod 134 and a conductive loop element 132 in a hinge region 131 between a top portion 135 and a bottom portion 133 of the communication device 130. Thus, the hinge serves as an antenna. The conductive element 131 can take the form of a wire, rectangular conductor, or printed conductive pattern on the ferrite, for example. This configuration may allow for increased usage of space within small devices, such as wireless cellular devices.

Figure 15:
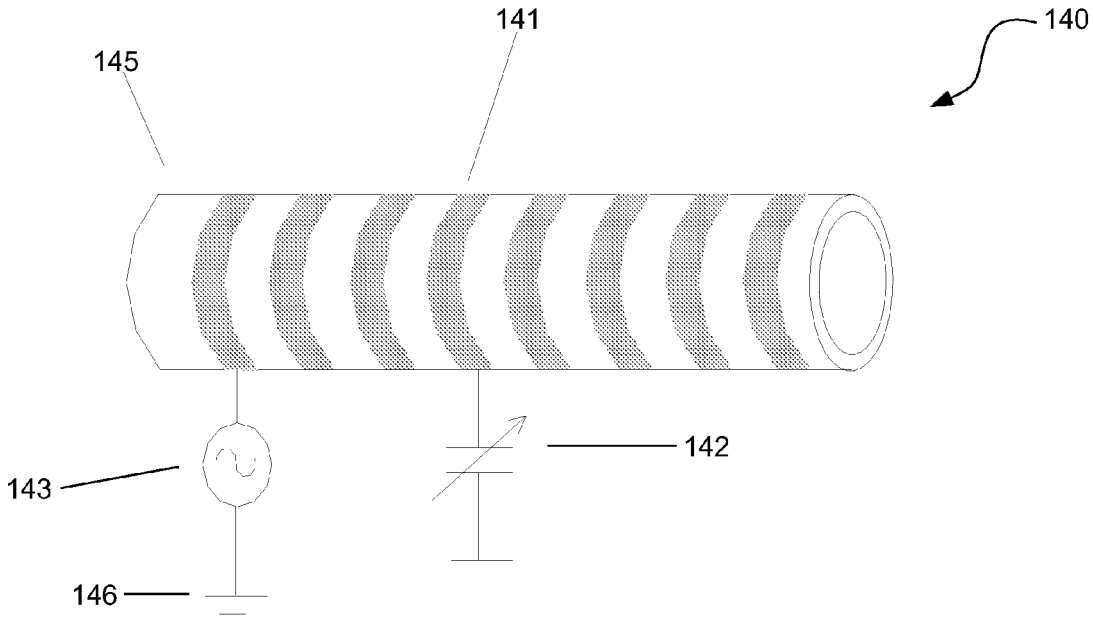
FIG. 15 illustrates an exemplary hinge assembly for a communication device in accordance with an embodiment of the present invention.
Figure 16:
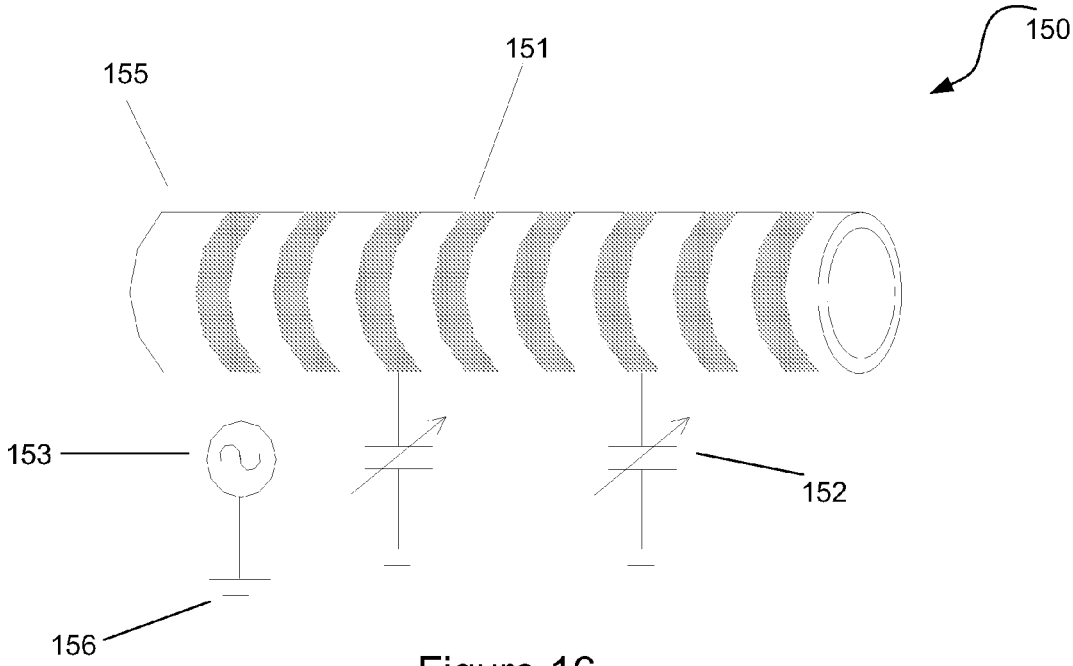
FIG. 16 illustrates an exemplary hinge assembly for a communication device in accordance with an embodiment of the present invention.

Referring now to FIG. 15, a hinge assembly 140 may be inclusive of an active component 142. The active component 142 may be coupled to the ferrite portion 145 of the ferrite loaded coil acting as the hinge. The addition of the active component 142 may allow for increased tuning of the antenna element. In addition, as illustrated in FIG. 16, multiple active components 152 may be coupled to the ferrite loaded coil. The conductive element 151 behaves as the radiating element of the circuit in this configuration. Thus, various embodiments provide the active tuning on the radiating element coupled to the active tuned loop.

FIG. 17 illustrates an exemplary hinge assembly for a communication device in accordance with an embodiment of the present invention. The hinge assembly 160 includes a ferrite core 165 with a conductive element 161 acting as the radiating element in the antenna. In this embodiment, an active component 162 is coupled to the radiating element in order to provide capacitive reactance to the loop and further tune the resonance. In addition, a general resonant circuit 164, inclusive of an active component 162 and a reactive element 167, is also coupled to the conductive, or radiating, element 161 in order to optimally achieve resonance within the device.

FIGS. 18A and 18B schematically illustrate an antenna in accordance with an embodiment of the present invention. The addition of a general reactive circuit 174 provides enough tunable reactance to generate additional resonance through the active tuned loops. The general reactive circuit 174 is inclusive of two or more reactive elements, such as a capacitor 177 and inductor 178, shown in FIG. 18B, for example. These reactive circuits 174 are placed between each parallel active tuned loop circuit in order to adjust the reactance at each node. Thus, this configuration may be preferable in devices commonly having to tune a broad range of differing frequency bands.

Figure 19:
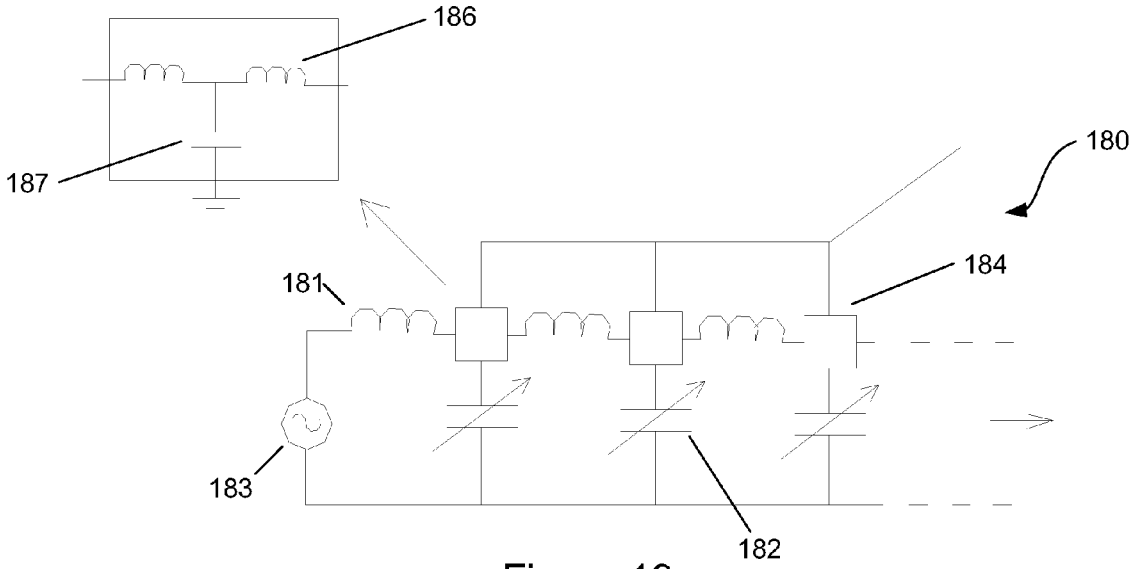
FIG. 19 is a schematic illustration of an antenna in accordance with an embodiment of the present invention.

Referring now to FIGS. 19A and 19B, an antenna in accordance with an embodiment of the present invention is schematically illustrated. The antenna 180 produces incremental and instantaneous bandwidths combined to cover larger bandwidth responses through the addition of a radiating element 185. In this embodiment, the radiating elements 185 are connected to one another to form a combined and more complex radiating element.

Figure 20:
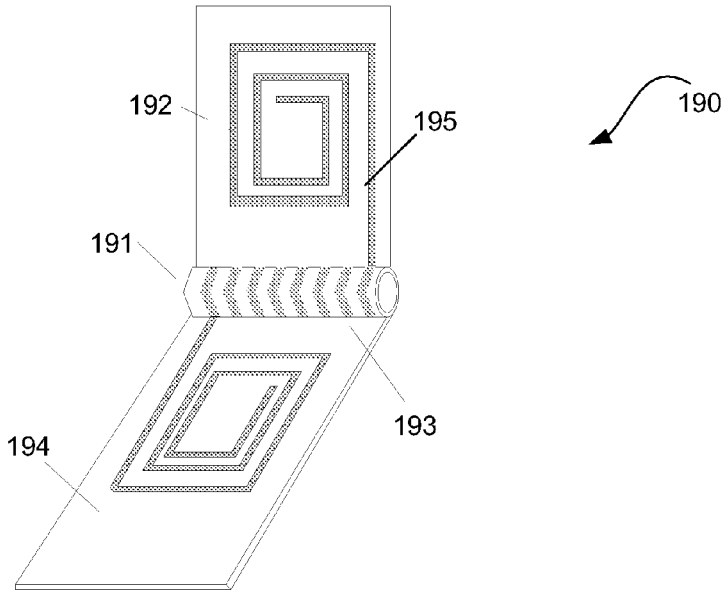
FIG. 20 illustrates an exemplary communication device with an antenna in accordance with an embodiment of the present invention.

Referring now to FIG. 20, an exemplary communication device with an antenna in accordance with an embodiment of the present invention is illustrated. The antenna is formed in a ferrite loaded hinge assembly. The antenna is provided with conductive elements attached to the ends of the conductive element 193 wrapped around the ferrite loaded hinge assembly 191. The spiral elements 195 can be attached to the housing on the top 192 and/or bottom 194 portions of the phone housing and can be on either or both surfaces. The element shape is not limited to a spiral, but can be a more generally shaped radiating element.

While particular embodiments of the present invention have been disclosed, it is to be understood that various different modifications and combinations are possible and are contemplated within the true spirit and scope of the appended claims. There is no intention, therefore, of limitations to the exact abstract and disclosure herein presented.

What is claimed is:

1. An antenna, comprising:

one or more active tuning components that provide an adjustable reactance;

one or more conductive elements in loop formations coupled to the one or more active tuning components; the combination of the one or more active tuning components and one or more conductive elements forming one or more active tuned loops; and one or more radiating elements coupled to said active tuned loops;

wherein said radiating elements are not conductively connected to said active tuned loops.

2. The antenna of claim 1, wherein the radiating elements are capacitively coupled to the active tuned loop.

3. The antenna of claim 1, wherein the active tuning component may include any of a varactor diode, tunable capacitor or switched capacitor network.

4. The antenna of claim 1, wherein the one or more radiating elements may be any one of monopoles, inverted F antennas (IFA), planar inverted F antennas (PIFA), IMD elements, or dipoles.

5. The antenna of claim 4, wherein one or more active components are coupled to the one or more radiating elements.

6. The antenna of claim 1, wherein said one or more radiating elements are magnetically coupled to the one or more active tuned loops.

7. The antenna of claim 1, wherein the antenna is positioned within a hinge region of a wireless device.

8. The antenna of claim 1, wherein the radiating element is a ferrite loaded coil antenna.

9. The antenna of claim 8, wherein the conductive element may be any one of a wire, rectangular conductor or printed conductive pattern.

10. The antenna of claim 8, wherein the coil is replaced with a radiating element.

11. The antenna of claim 8, wherein the ferrite is attached to a top surface of a shield can.

12. A method for configuring an antenna structure, comprising:

providing one or more active tuning components that provide an adjustable reactance;

coupling one or more conductive elements in loop formations to the one or more active tuning components; the combination of the one or more active tuning components and one or more conductive elements forming one or more active tuned loops; and coupling one or more radiating elements to said active tuned loops, wherein said coupling includes at least one of: capacitive or magnetic coupling.

13. The method of claim 12, wherein the radiating element is capacitively coupled with the active tuned loop.

14. The method of claim 12, wherein the active tuning component may include any of a varactor diode, tunable capacitor or switched capacitor network.

15. The method of claim 12, wherein the one or more radiating elements may be any one of monopoles, inverted F antennas (IFA), planar inverted F antennas (PIFA), IMD elements, or dipoles.

16. The method of claim 12, wherein one or more active components are coupled to the one or more radiating elements.

17. The method of claim 12, wherein one or more radiating elements are magnetically coupled to the one or more active tuned loops.

18. The method of claim 12, wherein the antenna is positioned within a hinge region of a wireless device.

19. The method of claim 12, wherein the radiating element is a ferrite loaded coil antenna.

20. The method of claim 19, wherein the conductive element may be any one of a wire, rectangular conductor or printed conductive pattern.

21. The method of claim 19, wherein the ferrite is attached to a top surface of a shield can.

22. An antenna, comprising:

a first active tuning component for providing a first adjustable reactance;

a first conductive element in a loop formation coupled to the first active tuning component to form a first active tuned loop;

a second active tuning component for providing a second adjustable reactance;

a second conductive element in a loop formation coupled to the second active tuning element to form a second active tuned loop;

wherein said first active tuned loop is connected to said second active tuned loop; and wherein said first and second active tuned loops are each adapted to radiate an electromagnetic signal.

23. The antenna of claim 22, further comprising one or more radiating elements; wherein said radiating elements are coupled to said active tuned loops.

24. The antenna of claim 23, wherein said radiating elements are electrically connected to said active tuned loops.

25. The antenna of claim 23, wherein said radiating elements are capacitively coupled to said active tuned loops.

26. The antenna of claim 23, wherein said radiating elements are magnetically connected to said active tuned loops.

27. The antenna of claim 23, wherein said radiating elements may be any one of monopoles, inverted F antennas (IFA), planar inverted F antennas (PIFA), IMD elements, or dipoles.

* * * * *